US007492064B1

(12) United States Patent
Vaughn

(10) Patent No.: US 7,492,064 B1
(45) Date of Patent: Feb. 17, 2009

(54) LUMINAIRE SAFETY SYSTEM

(75) Inventor: John I. Vaughn, Shreveport, LA (US)

(73) Assignee: Signal Engineering Company-South, Shreveport, LA (US)

( * ) Notice: Subject to any disclaimer, the term of this patent is extended or adjusted under 35 U.S.C. 154(b) by 287 days.

(21) Appl. No.: 11/329,892

(22) Filed: Jan. 10, 2006

(51) Int. Cl.
*H01H 35/00* (2006.01)

(52) U.S. Cl. ..... 307/119

(58) Field of Classification Search ..... 307/119
See application file for complete search history.

(56) References Cited

U.S. PATENT DOCUMENTS

| | | | | |
|---|---|---|---|---|
| 342,552 | A | 5/1886 | Westinghouse | |
| 1,189,459 | A | 7/1916 | Lundin | |
| 1,776,682 | A | 9/1930 | King | |
| 3,187,175 | A | 6/1965 | Lang | |
| 3,225,224 | A | 12/1965 | Rydbeck | |
| 3,364,635 | A | 1/1968 | Guggemos | |
| 3,760,234 | A | 9/1973 | Jones et al. | |
| 3,862,411 | A | 1/1975 | Persson | |
| 4,237,530 | A | 12/1980 | Murray et al. | |
| 4,617,768 | A | 10/1986 | Gebelius | |
| 4,698,717 | A | 10/1987 | Scheid | |
| 4,827,389 | A | 5/1989 | Crum | |
| 4,878,160 | A | 10/1989 | Reneau et al. | |
| 4,911,652 | A | 3/1990 | Savoca et al. | |
| 5,161,874 | A | 11/1992 | Benes | |
| 5,162,617 | A | 11/1992 | Ferbas | |
| 5,267,880 | A * | 12/1993 | Tamm | 439/620.29 |
| 5,276,583 | A | 1/1994 | Tyson | |
| 5,335,160 | A | 8/1994 | Savoca | |
| 6,127,782 | A * | 10/2000 | Flory et al. | 315/129 |
| 6,303,857 | B1 | 10/2001 | Ginsburg | |
| 6,377,001 | B2 | 4/2002 | Levy | |
| 2002/0027510 | A1 | 3/2002 | Jones et al. | |

* cited by examiner

*Primary Examiner*—Robert L. Deberadinis
(74) *Attorney, Agent, or Firm*—Russel O. Primeaux; Pamela A. Baxter; Kean, Miller, Hawthorne, D'Armond, McCowan & Jarman, LLP

(57) ABSTRACT

A safety system for powering an outdoor light is provided. The system includes a breakaway cable which runs from the luminaire pole to the junction box. The breakaway is connected to a switch which is opened when the breakaway cable is pulled, for example when the luminaire pole is struck. The device may also include a visual indicator at the junction box which indicates whether power is being supplied to the luminaire.

5 Claims, 2 Drawing Sheets

LUMINAIRE SAFETY SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

BACKGROUND OF THE INVENTION

1. Field of the Invention

The present invention relates to street and outdoor lighting. More particularly, the invention relates to safety systems for supplying electrical power to luminaire poles used for street lighting.

2. Description of Related Art

U.S. Pat. No. 5,335,160 to Savoca discloses a luminaire power system that is intended to stop the flow of power to the luminaire pole in the event of the abrupt displacement of the pole. Such a displacement can occur if a motor vehicle strikes the pole. However, Savoca does not provide a visual indicator so that emergency or maintenance personnel who arrive at an accident scene can ascertain whether power is being supplied to the luminaire. Additionally, Savoca uses only a single unplugging action to stop power from reaching the luminaire pole. Another shortcoming of Savoca is that the fuse in Savoca is part of the load cable. Therefore in the Savoca device, power could still be running in the junction box in the event of a short somewhere in the Savoca load cable.

Because the Savoca fuse assembly is located in the load cable, one can have the situation in which the luminaire has been displaced (but with no shorting) thereby unplugging the Savoca load cable, yet power will still be throughout the length of the load cable. This power in the load cable can still create a dangerous situation for emergency and maintenance personnel, especially without any visual indicators to indicate the power status in the load cable.

The prior art demonstrates a need for a power supply system that does not endanger rescue and maintenance personnel, that provides clear cessation of power if the luminaire pole is displaced from its foundation, and that provides an indicator of whether power is being supplied.

SUMMARY OF THE INVENTION

A novel luminaire safety system is disclosed. The system includes four key safety elements. The first key safety element is that the fuse assembly is located on the power side of a waterproof enclosure, which is located underground in a junction box. Secondly, the system uses a load cable that runs from the waterproof enclosure to the luminaire pole. This load cable terminates in a splice segment which is detachably connected to the cable in the luminaire pole. The splice segment is selected so that the displacement of the pole will separate the two cables at the splice segment so as not to tear the cables. Thirdly, the system includes a trip mechanism that is located in the waterproof enclosure.

The trip mechanism is activated by a separate trip cable that runs from the waterproof enclosure to the base of the luminaire. Even if the load cable and luminaire cable fail to separate from each other at the splice segment, the trip mechanism will ensure that no power is running from the junction box to the luminaire cable. The fourth safety element is that inside the junction box are visual indicators which indicate whether power is running to the load cable.

An object of the invention is to provide a luminaire safety system which de-energizes in the event that the luminaire pole is displaced from its foundation.

An additional object of the invention is to provide a visual indicator that will show maintenance or emergency personnel the status of the power being supplied to the luminaire pole.

An additional object of the invention is to provide a system that includes two methods for de-energizing a luminaire pole.

An additional object of the invention is to prevent inadvertent disconnection of the cables that supply power to the luminaire unless the appropriate tensile force is achieved.

The present invention has several advantages over the prior art systems. One advantage of the present invention is that it can be easily adapted to existing luminaire pole and junction box configurations.

These and other objects, advantages, and features of this invention will be apparent from the following description.

DETAILED DESCRIPTION OF THE INVENTION

Figure 1:
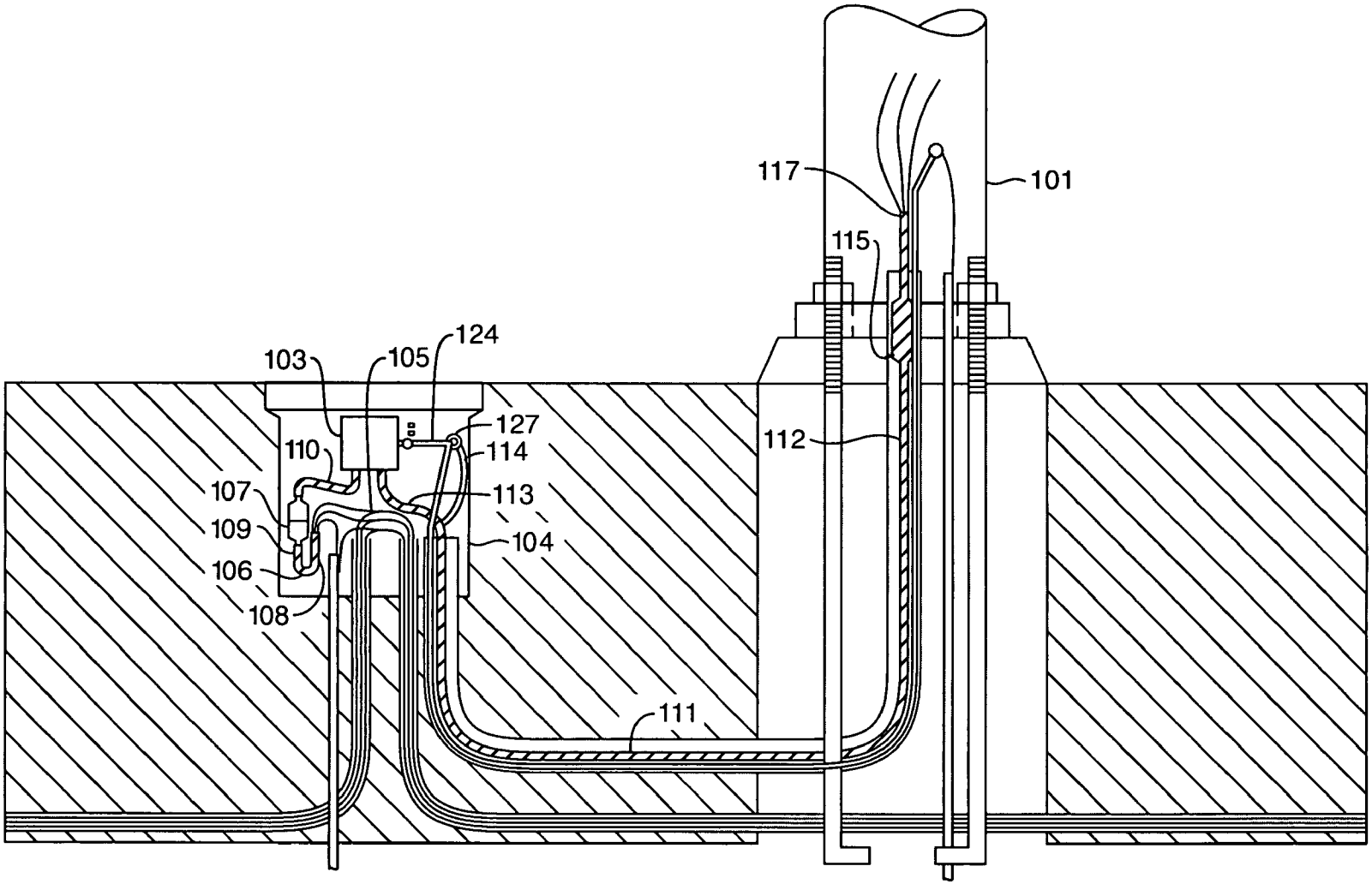
FIG. 1 is a plan view depicting an embodiment of the luminaire safety system.

A preferred embodiment of the invention is shown in FIG. 1. FIG. 1 depicts luminaire pole 101 and junction box 104. Waterproof enclosure 103 is contained within junction box 104. Power comes into junction box 104 through primary power cable 105. Fused supply cable 106 has supply cable free end 108, which is spliced into primary power cable 105, and supply cable fuse end 109, which terminates in fused plug 107. Enclosure power cable 110 is connected at one end to fused plug 107 by a mateable plug. The other end of enclosure power cable 110 goes into waterproof enclosure 103.

Figure 2:
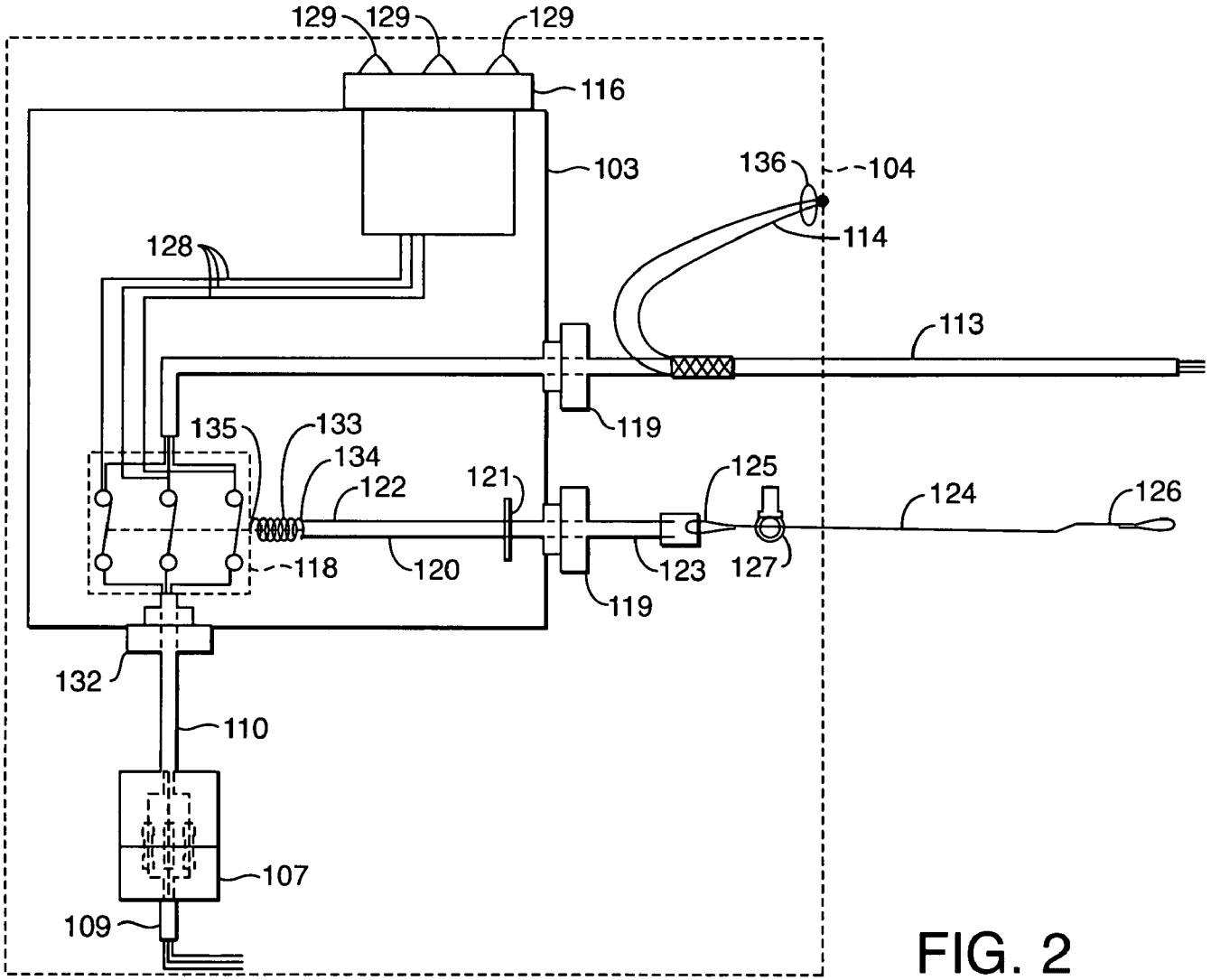
FIG. 2 is an electrical schematic diagram depicting the junction box and relevant connecting components of the invention.

Load cable 111 has load cable luminaire end 112 and load cable junction box end 113. Load cable junction box end 113 goes into waterproof enclosure 103. As shown in FIG. 2, one end of load cable anchor 114 is fixably connected to load cable junction box end 113 while the other end of load cable anchor 114 is fixably attached to junction box 104. In one preferred embodiment load cable anchor 114 is a Kellem grip attached at one end to load cable junction box end 113 and at other end attached by eye bolt 136 to junction box 104. In a particularly preferred embodiment one eye bolt can serve as both eye bolt 136 and cable guide 127. With load cable anchor 114 in place, if a pulling force is exerted on load cable 111, pulling load cable 111 away from junction box 104, load cable anchor 114 will serve to prevent load cable 111 from being pulled out of waterproof enclosure 103.

Load cable luminaire end 112 terminates in splice section 115. Splice section 115 electrically connects load cable 111 to luminaire cable 117. Load cable 111, luminaire cable 117, and splice section 115 are chosen such that the force necessary to separate at splice section 115 is less than the force needed to displace load cable anchor 114. Luminaire cable 117 continues up into luminaire pole 101 where it is connected to the light (not shown).

With reference to FIG. 2, the operation and components of waterproof enclosure 103 will now be described. Enclosure power cable 110 comes through cable seal 132 at a sidewall of waterproof enclosure 103 and terminates in three pole switch 118. Lever 131 (not shown) of three pole switch 118 is connected to switch rod 120 via attenuating spring 133. Stop pin 121 limits the travel of switch rod 120. The holes allowing switch rod 120 and load cable junction box end 113 to pass through the sidewall of waterproof enclosure 103 includes sealing means 119 which prevents water from entering waterproof enclosure 103.

In normal operation switch rod 120 will be in the set position (this position may also be referred to as the ready or loaded position) wherein switch rod first end 122 is attached to first end 134 of attenuating spring 133. Attenuating spring second end 135 is attached to lever 131 (not shown) of three pole switch 118. Switch rod second end 123 will protrude outside of waterproof enclosure 103. Breakaway cable first end 125 of breakaway cable 124 is attached to switch rod second end 123. As shown in FIG. 1, breakaway cable second end 126 is fixably attached to luminaire pole 101 by a bolt or some other fastening means. Within junction box 104, breakaway cable 124 is routed through cable guide 127. As noted above, in one embodiment, cable guide 127 can also serve as the eye bolt 136, which attaches load cable anchor 114 to junction box 104. Cable guide 127 is positioned such that it is roughly in line with the long axis of switch rod 120. This alignment will ensure a smooth operation of switch rod 120 in the event of the sudden displacement of luminaire pole 101. In another preferred embodiment, cable guide 127 can be a casement assembly which comprises a cylindrically shaped conduit (not shown) through which breakaway cable 124 is routed. The scope of this invention is intended to include any configurations of cable guide 127 which serve to prevent binding of breakaway cable 124.

In one preferred embodiment, breakaway cable first end 125 is connected to switch rod second end 123 so that these two components will separate after three-pole switch 118 has been tripped into the off position and if breakaway cable 124 continues to pull on switch rod 120. In a particularly preferred embodiment, breakaway cable first end 125 will separate from switch rod second end 123 with a force of 20 pounds.

When luminaire pole 101 is displaced—for example—when it is struck by an out of control automobile—switch rod second end 123 is pulled away from three pole switch 118, thereby putting three pole switch 118 in the tripped (open) position. As shown in FIG. 1, in the tripped position, no power will flow from enclosure power cable 110 to load cable 111. A maintenance or emergency worker can easily ascertain the status of the power being transmitted to load cable 111 by looking at visual indicators 129 on monitor 116. When three-pole switch 118 is in the loaded (on) position, visual indicators 129 will be illuminated, indicating that power is flowing into load cable 111. When three pole switch 118 is in the open (off) position, visual indicators 129 will not be illuminated, indicating that no power is flowing to load cable 111.

The invention provides two separate mechanisms for ensuring that no power is being transmitted to luminaire pole 101 when luminaire pole 101 is displaced from its base. The first mechanism is that breakaway cable 124 will pull on switch rod 120 and send three-pole switch 118 into the tripped position. The second mechanism is that luminaire cable 117 will separate from load cable luminaire end 112 at splice section 115. This separation occurs because load cable 111 is fixably attached to junction box 104 by load cable anchor 114.

There are of course other alternate embodiments which are obvious from the foregoing descriptions of the invention, which are intended to be included within the scope of the invention, as defined by the following claims.

The invention claimed is:

1. An outdoor lighting system for connection to a primary power cable comprising:

(1) a junction box having a waterproof enclosure, said waterproof enclosure being electrically connected to said primary power cable;

(2) a luminaire pole having a luminaire cable;

(3) a breakaway cable fixably connected into said waterproof enclosure at one end and to said luminaire pole at its other end;

(4) a load cable electrically connected into said junction box at one end and electrically connected to said luminaire cable at its other end;

(5) a means for switching off the power supplied from said junction box to said load cable in response to the displacement of said luminaire pole, said switching means being housed within said waterproof enclosure and said switching means being electrically connected to said load cable intermediate said primary power cable and said luminaire cable.

2. The outdoor lighting system of claim 1, further comprising a visual indicator intermediate said primary power cable and said luminaire cable, said visual indicator having means for indicating whether power is being supplied to said load cable.

3. An outdoor lighting system for connection to a primary power cable comprising:

(1) a junction box having a waterproof enclosure;

(2) a power supply cable electrically connected intermediate said junction box and said primary power cable, said power supply cable further comprising a fuse assembly;

(3) a luminaire pole having a luminaire cable;

(4) a load cable electrically connected into said junction box and to said luminaire cable; and (5) a visual indicator intermediate said fuse assembly and said luminaire cable, said visual indicator having means for indicating whether power is being supplied to said load cable.

4. The outdoor lighting system of claim 1, wherein said power supply cable further comprises a fuse assembly.

5. The outdoor lighting system of claim 4, further comprising a visual indicator intermediate said primary power cable and said luminaire cable, said visual indicator having means for indicating whether power is being supplied to said load cable.

* * * * *